United States Patent [19]

Sample

[11] 4,225,013

[45] Sep. 30, 1980

[54] UPRIGHT CLIMBING AND PLATFORM DEVICE

[76] Inventor: George A. Sample, 1956 First Pl., SW., Vero Beach, Fla. 32960

[21] Appl. No.: 35,690

[22] Filed: May 3, 1979

[51] Int. Cl.[3] ..... A63B 27/02; A47C 9/10

[52] U.S. Cl. ..... 182/134; 182/187

[58] Field of Search ..... 182/133, 134, 135, 221, 182/187

[56] References Cited

U.S. PATENT DOCUMENTS

| | | | |
|---|---|---|---|
| 117,413 | 7/1871 | Hanger | 182/134 |
| 857,430 | 6/1907 | Youngquist | 182/134 |
| 877,418 | 1/1908 | Foldvik | 182/134 |
| 1,091,277 | 3/1914 | Bloom | 182/134 |
| 2,039,185 | 4/1936 | Pfistershammer | 182/134 |
| 4,161,233 | 7/1979 | Wirtz | 182/187 |

FOREIGN PATENT DOCUMENTS

| | | | |
|---|---|---|---|
| 629762 | 8/1927 | France | 182/134 |

*Primary Examiner*—Reinaldo P. Machado
*Attorney, Agent, or Firm*—Carroll F. Palmer

[57] ABSTRACT

A device for climbing trees, poles, ship masts or similar uprights and providing a platform upon which the climber may sit for observation or work purposes after climbing comprises a clamping part and a platform part. The clamping part provides a C-shaped arrangement of adjustable size formed of two telescoping elements held at an obtuse angle to the platform part. In use, the platform part is strapped to the user foot and the clamping part extends around the tree or like to be climbed. The user can virtually walk up the tree, pole, etc. and because the clamping part has a side opening, tree limbs, or similar obstructions do not impede the climbing.

7 Claims, 9 Drawing Figures

FIG. 4
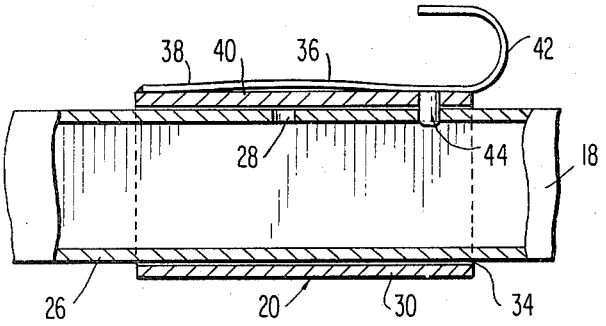
FIG. 6
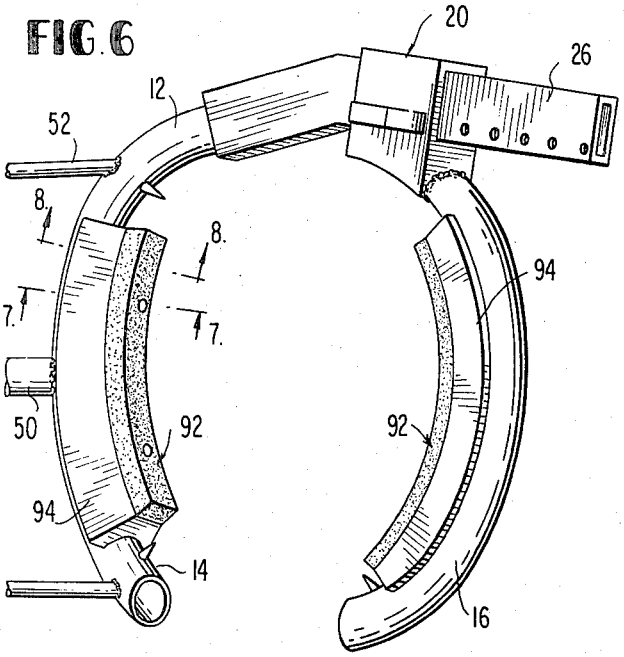
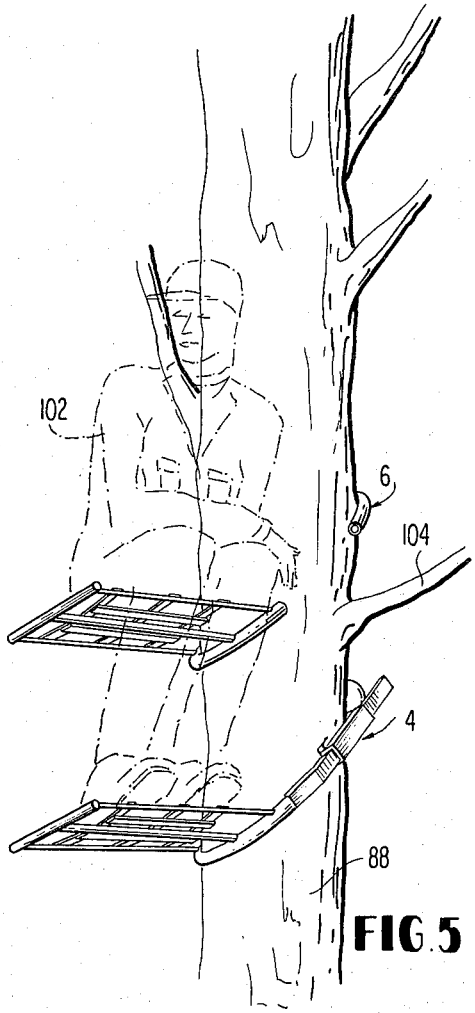
FIG. 5
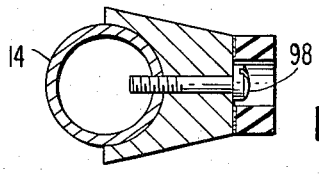
FIG. 8
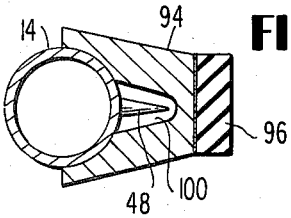
FIG. 7
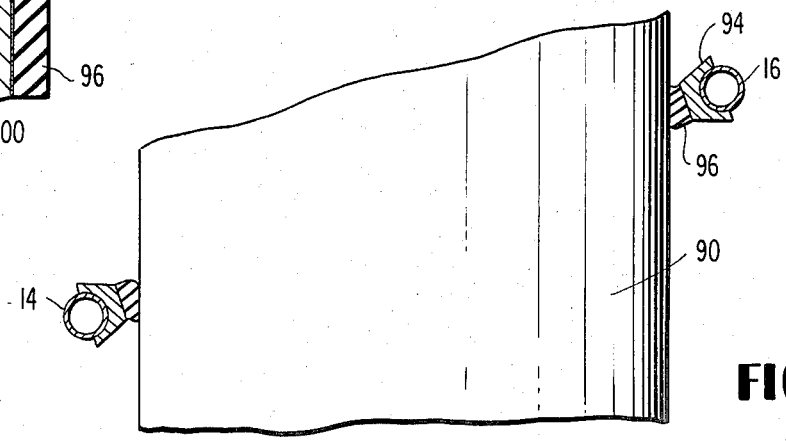
FIG. 9

UPRIGHT CLIMBING AND PLATFORM DEVICE

BACKGROUND OF THE INVENTION

1. Field of the Invention

This invention relates to devices for climbing trees, poles, ship masts or similar columnar uprights and providing a platform upon which the user may sit after climbing.

2. Description of the Prior Art

There are a variety of activities which require persons to climb columnar uprights, e.g., hunters in a woods, linemen climbing poles or sailors climbing ship masts. Moreover, once the upright has been climbed, it is often desireable for the climber to have a platform upon which to sit for observation or work purposes.

The need for climbing poles or the like has resulted in a variety of devices for climbing only, e.g., see U.S. Pat. Nos. 117,413; 877,418 and 2,039,185. Some devices of this type gripper teeth or pegs, e.g., see U.S. Pat. No. 1,091,277 and some are equipped with resilient anti-slip pads, e.g., see U.S. Pat. No. 857,430.

The need for both climbing and sitting after the climb has resulted in yet another variety of devices, e.g., see U.S. Pat. Nos. 3,460,649; 3,856,111 and 3,955,645.

Of course, climbing a uniform upright such as a telephone pole is simpler than climbing a non-uniform upright such as a tree with protruding limbs or like obstructions. Notwithstanding the numerous climbing or combination climbing/platform devices developed heretofore, among which are those cited above, there exists a need for improved devices of this type that may be used to climb columnar uprights easily and safely even to heights above tree limbs, mast spreaders or like obstructions and then provide a platform upon which the climber may sit after he has climbed to the desired height.

OBJECTS

A principal object of this invention is the provision of new improved forms of devices for climbing trees, poles or other columnar uprights and for providing a platform upon the upright from which the climbers may work, observe or perform some other activity.

A further object is the provision of such devices that enable the climber to easily by-pass tree limbs, mast spreaders or comparable obstructions existing in the climbing path.

Another object is the provision of such devices that can be safely and easily used by a climber.

Yet another object is the construction of such climbing devices so they are strong, light in weight and capable of easy adjustment to accomodate various sizes of trees or other uprights to be climbed.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The foregoing objects are accomplished in accordance with this invention by forming a climbing and observation platform device to comprise a pair of right and left climber members to be applied to the right and left feet respectively of a climber. Each climber member comprises a clamping part and a platform part. The clamping part, which in use partly encircles the upright to be climbed, comprises a J-shaped element, a tubular arcuate element telescopically carried on the leg portion of the J-shaped element and means to lock the arcuate element on the J-shaped element in a C-shaped arrangement that can be adjusted in size to accomodate uprights of different peripheral measurements.

The platform part, which in use is fastened to the foot of the user, comprises a plurality of parallel members fixed, such as by welding, at one end to the base portion of the J-shaped element of the clamping part so that the clamping part is positioned at an obtuse angle relative to the platform part. The platform part further comprises a transverse tubular member fixed at the other end to the parallel members, a support member carried upon the upper surface of said parallel members and strap means to fasten the user's foot to the plate member.

BRIEF DESCRIPTION OF THE DRAWINGS

A more complete understanding of the climbing/platform device of the invention may be obtained by reference to the accompanying drawings in which:

FIG. 2 is a plan view of the left climber member of FIG. 1.

FIG. 4 is a fragmentary, enlarged sectional view taken on the line 4—4 of FIG. 2.

FIG. 5 is a perspective view showing the left and right climber members of the device of the invention positioned as a platform upon a tree.

FIG. 6 is a fragmentary, plan view of the clamping part of the left climber member of FIG. 1 equipped with resilient pads as when the device of the invention is used to climb the mast of a ship.

FIG. 7 is a sectional view taken on the line 7—7 of FIG. 6.

FIG. 8 is a sectional view taken on the line 8—8 of FIG. 6.

FIG. 9 is a sectional view of the climber member of FIG. 6 positioned upon a ship's mast.

DESCRIPTION OF PREFERRED EMBODIMENTS

Figure 1:
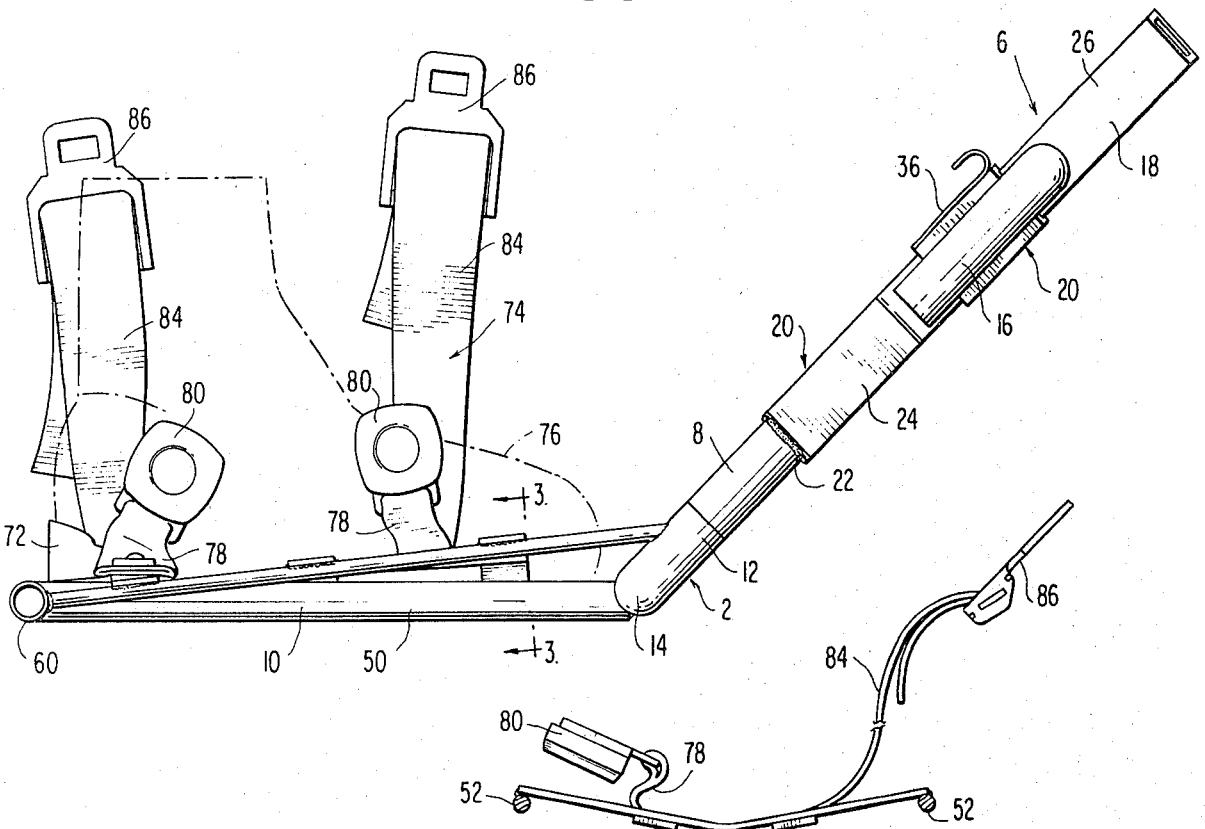
FIG. 1 is a lateral view of a left climber member of a climbing and platform device of the invention.
Figure 3:
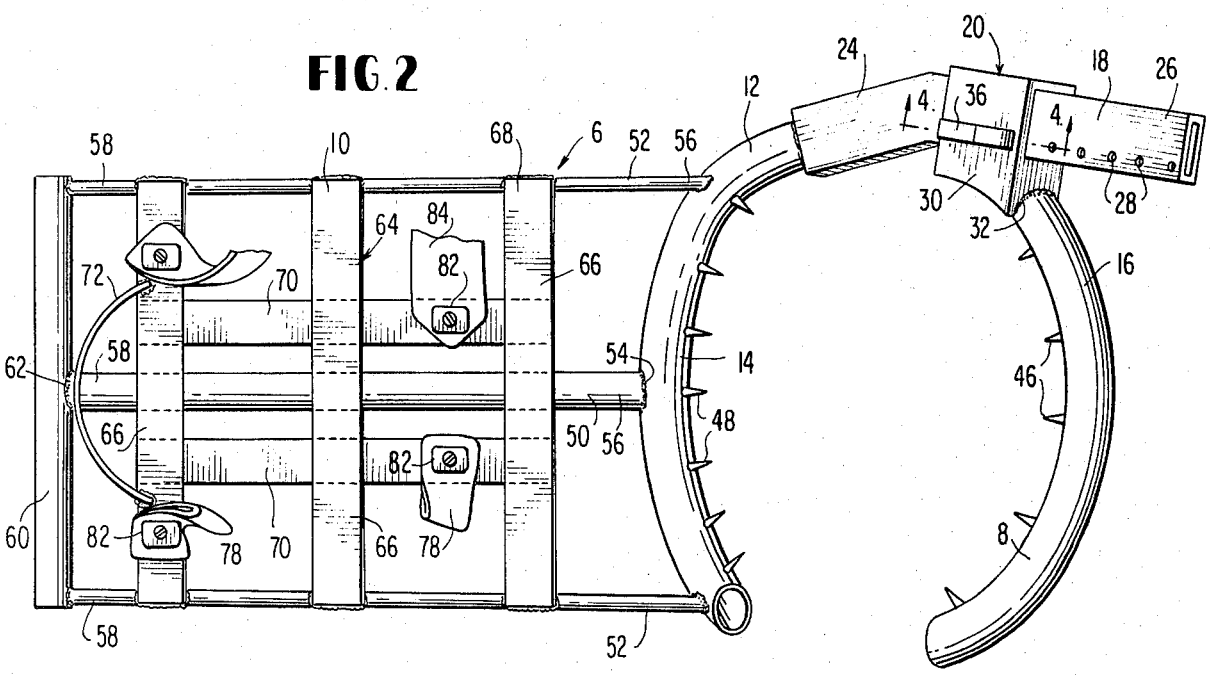
FIG. 3 is a sectional view taken on the line 3—3 of FIG. 1.

Referring in detail to the drawings, an upright climbing and platform device 2 of the invention comprises a pair of right and left climber members 4 and 6 respectively. Each climber member comprises a clamping part 8 and a platform part 10.

The clamping part 8 comprises a tubular J-shaped element 12 fixed at its base portion 14 to the platform part 10 at an obtuse angle relative to the plane of the platform part. It also comprises a tubular arcuate element 16 telescopically carried on the leg portion 18 of the J-shaped element 12 and means 20 to lock element 16 on element 12 in a C-shaped arrangement as shown.

Advantageously, the base portion 14 of element 12 is formed of tubing of circular cross-section and the leg portion 18 is formed of tubing of square or rectangular cross-section with the portions 14 and 18 being joined together such as by welding 22. Preferrably, the proximal section 24 of leg portion 18 is angled relative to the distal section 26.

The lock means 20 comprises a series of holes 28 in the upper surface of distal section 26 of leg portion 18. It further comprises a block member 30 fixed by welding 32 to tubular arcuate element 16. Block member 30 has a rectangular bore 34 therethrough sized to snuggly embrace the leg portion 18 of J-shaped element 12 permitting block member 30 to slide along the distal section 26 of leg portion 18. The lock means 20 also comprises a leaf spring 36 fixed, such as by welding, at one end 38 to the upper face 40 of block member 30. The other end 42 of spring 36 is C-shaped to provide a finger grip and a pin 44 is fixed thereon so that it may be projected into anyone of the holes 28 in leg portion 18 of element 12.

The clamping part 8 preferrably has a plurality of pegs 46 fixed to the arcuate element 16 so as to project inwardly in the C-shaped arrangement of elements 12 and 16. Similarly, a plurality of pegs 48 are fixed to the J-shaped element 12. The pegs 46 and 48 may be fixed to the respective elements 16 and 12 by welding, by being threaded therein, riveted thereto or the like.

The platform part 10 comprises a central tubular member 50 and a pair of parallel members 52. Advantageously, the members 52 are rods of smaller diameter than the tube 50, but they could, if desired, be made of tubing such as member 50. Alternatively, the members 50 and 52 could be formed from stock of square, rectangular, etc. cross-section, rather than circular cross-section.

The parallel, substantially straight members 50 and 52 are fixed, such as by welding 54, at their inner ends 56 to the base portion 14 of element 12. Advantageously, the outer members 52 are raised at a slight angle relative to the longitudinal plane of member 50.

To the outer ends 58 of members 50 and 52 there is fixed a transverse member 60 such as by welding 62. Advantageously, member 60 is made of the same tubular stock as member 50 to secure sufficient strength to the outer perimeter of the platform part 10 while in use in the sitting position, but stock of other cross-section and other material can be used.

The platform part 10 further comprises a support member 64 upon which to support the foot of the user of the device 2. The member 64 comprises a plurality of transverse metal strips 66 fixed at their ends 68 to members 52 and a plurality of longitudinal metal strips 70 fixed to the strips 66 at the points of intersection of the respective strips. Member 64 further comprises a heel plate fixed, such as by welding to the rearward strip 66 and to member 50.

In place of strips 66 and 70, the support member 64 could consist of a plate (not shown) fixed to members 50 and 52.

The platform part 10 also comprises strap means 74 to fasten the users foot 76 to the support member 64. Means 74 comprises inner straps 78 fitted at one end with buckel snaps 80 and fixed at their other ends to a strip 70 by fasteners 82. Means 74 also comprises outer straps 84 fitted at one end with buckel tongues 86 and fixed at their other ends to a strip 70 by fasteners 82. In use of the device 2, the straps 84 are adjusted in length to accomodate the size of the users boot or shoe by positioning of tongues 86 on the straps 84 and then strap means 74 is buckelled in known manner about the users foot.

The pegs 46 and 48 of the clamping part 8 help to prevent slippage of the climber members 4 and 6 on a wooden upright such as a tree 88. However, in climbing a metal upright, such as a ship mast 90, pegs 46 and 48 would promote slippage and could damage the upright. For such use, pad members 92 are provided. These comprise arcuate parts 94 of V-shaped cross-section and resilient strips 96 cemented to the parts 94. The pad members 92 are fixed to the base protion 14 of element 12 and arcuate portion 16 by bolts 98. Cavities 100 are formed in the parts 94 to provide spaces to accomodate the pegs 46 and 48.

To use the device 2 to climb an upright such as tree 88, the right climber member 4 is strapped about the right foot and the left climber member is strapped about the left foot of the user 102. The size of the C-shaped arrangement of elements 12 and 16 on each climber member is then adjusted, by manipulation of the spring 36 and pin 44 to move lock means 20 relative to section 26 of element 12, so that the climber members 4 and 6 may be positioned about the tree 88 near its base. The user can then climb the tree 88 by virtually walking up to tree to a desired location. At such point, the user may unstrap his feet from the climber members 4 and 6 and assume a sitting position thereon as shown in FIG. 5. In making the ascent up the tree, limbs 104 do not impede the climb since the opening at the side of the C-shaped arrangements permit the climber to by-pass such obstructions.

Most trees and many poles are tapered so their diameter is greater at the base than higher up. Such taper would cause the platform parts 10 of the climbing devices 2 to droop as the upright is climbed. However, since the element 16 can be easily adjusted relative to element 14 as the climber ascends the tapered upright, the platform parts can be maintained in a level condition throughout the climb. Such adjustment is accomplished by manipulation of lock means 20 on either the right member 4 or left member 6 while the full wieght of the climber is supported on the other member.

The embodiments of the invention in which an exclusive property or privilege is claimed are defined as follows:

1. Combination climbing and platform device comprising a pair of right and left climber members each comprising a clamping part and a platform part, said clamping part comprising a tubular J-shaped element fixed at its base portion to said platform part at an obtuse angle relative to the plane of said platform part, a tubular arcuate element telescopically carried on the leg portion of said J-shaped tubular element and means to lock said arcuate element on said J-shaped element in a C-shaped arrangement at a plurality of positions providing adjustment in size of the C-shaped arrangement, said platform part comprising a plurality of substantially parallel elongated members each fixed at one end to said base of said J-shaped element and fixed at the other end to a transverse tubular member, a support member upon which to support a foot of the user of said device and strap means to fasten the users foot to said support member.

2. The device of claim 1 wherein said platform part comprises three parallel elongated members, the middle one being a metal tube and the outside ones being rods of smaller diameter than said metal tube.

3. The device of claim 2 wherein said tube and rods are welded to said base portion of said J-shaped element with said rods being positioned at a slight angle relative to said tube in the plane of said platform part and above said support member.

4. The device of claim 1 wherein said arcuate element has a plurality of pegs fixed thereto to project inwardly in said C-shaped arrangement.

5. The device of claim 4 wherein said J-shaped element has a plurality of pegs fixed thereto to project inwardly in said C-shaped arrangement.

6. The device of claim 1 wherein said means to lock said arcuate element comprises a spring biased pin that extends through holes in said leg portion of said J-shaped element.

7. The device of claim 1 having resilient pads that fit over said J-shaped element and said arcuate element to provide gripping action on a mast or similar smooth surface upright that may be climbed with said device.

* * * * *